US009878417B2

(12) United States Patent
Junker

(10) Patent No.: US 9,878,417 B2
(45) Date of Patent: Jan. 30, 2018

(54) METHOD FOR THE CENTRELESS GRINDING OF SHAFT PARTS, IN PARTICULAR OF TUBES FOR ASSEMBLED CAMSHAFTS, AND GRINDING-WHEEL AND REGULATING-WHEEL PAIR PROVIDED FOR THIS PURPOSE

(71) Applicant: ERWIN JUNKER GRINDING TECHNOLOGY A.S., Melnik (CZ)

(72) Inventor: Erwin Junker, Buehl/Baden (DE)

(73) Assignee: ERWIN JUNKER GRINDING TECHNOLOGY A.S., Melnik (CZ)

( * ) Notice: Subject to any disclaimer, the term of this patent is extended or adjusted under 35 U.S.C. 154(b) by 18 days.

(21) Appl. No.: 14/903,202

(22) PCT Filed: Jun. 16, 2014

(86) PCT No.: PCT/EP2014/062525

§ 371 (c)(1),
(2) Date: Jan. 6, 2016

(87) PCT Pub. No.: WO2015/007444

PCT Pub. Date: Jan. 22, 2015

(65) Prior Publication Data

US 2016/0151875 A1 Jun. 2, 2016

(30) Foreign Application Priority Data

Jul. 19, 2013 (DE) ..... 10 2013 214 226

(51) Int. Cl.

| | |
|---|---|
| ***B24B 5/30*** | (2006.01) |
| ***B24B 5/22*** | (2006.01) |
| ***B24B 5/24*** | (2006.01) |
| ***B24B 5/28*** | (2006.01) |

(52) U.S. Cl.

CPC ..... *B24B 5/30* (2013.01); *B24B 5/22* (2013.01); *B24B 5/24* (2013.01); *B24B 5/28* (2013.01)

(58) Field of Classification Search

CPC .... B24B 5/30; B24B 5/22; B24B 5/24; B24B 5/28

USPC ..... 451/242, 244, 49, 442, 243, 51

See application file for complete search history.

(56) References Cited

U.S. PATENT DOCUMENTS

| | | | | |
|---|---|---|---|---|
| 1,640,993 | A * | 8/1927 | Hanson | B24B 19/022 33/199 B |
| 2,280,620 | A * | 4/1942 | Binns | B23B 31/22 279/2.01 |
| 2,525,591 | A * | 10/1950 | Cotchett | D01H 5/74 19/295 |

(Continued)

FOREIGN PATENT DOCUMENTS

| | | | |
|---|---|---|---|
| DE | 10308292 | B4 | 8/2007 |
| JP | S6025640 | A | 2/1985 |
| JP | 2004167610 | A | 6/2004 |

OTHER PUBLICATIONS

International Search Report for International Application No. PCT/EP2014/062525, dated Jan. 10, 2014.

German Office Action for Application No. 10 2013 214 226.9, dated May 13, 2014.

*Primary Examiner* — Robert Rose

(74) *Attorney, Agent, or Firm* — Marshall, Gerstein & Borun LLP

(57) ABSTRACT

The invention provides a method for the centerless grinding of shaft parts (9), in particular of tubes for assembled camshafts, in the case of which the shaft part (9) which is to be ground, and has axial centering portions (11) on its end sides, is ground in rotatably driven fashion, in a manner which is customary in centerless grinding, in a gap between the grinding wheel (1) and regulating wheel (2). The grinding wheel (1) and regulating wheel (2) have a width which corresponds at least to the length of the shaft part (9). The (Continued)

shaft part (9) is ground in its end regions (28) first of all concentrically in relation to the centering portions (11), and this produces ground formations concentrically in relation to the centering portions (11). This is followed by the grinding of the intermediate region (29), which is located between the end regions (28), and then by the entire shaft part (9) being ground to size in a dimensionally accurate and dimensionally stable manner on the basis of the ground formations at the end regions (28) of the shaft part (9), said formations being made concentrically in relation to the centring portions (11) and resting on a support (16). In order to implement the method, the invention provides an appropriately dimensioned grinding-wheel and regulating-wheel pair (1, 2) in a centreless grinding machine, in the case of which regions of increased diameter, i.e. a respective profiling, are/is provided in the side regions of said machine in order to grind the end regions (28) of the shaft part (9).

10 Claims, 7 Drawing Sheets

(56) References Cited

U.S. PATENT DOCUMENTS 3,108,411 A * 10/1963 D'Errico ..... B24B 5/35
451/242
3,418,763 A 12/1968 Soderquist
4,009,538 A * 3/1977 Hanecker ..... B24B 41/00
451/243

* cited by examiner

METHOD FOR THE CENTRELESS GRINDING OF SHAFT PARTS, IN PARTICULAR OF TUBES FOR ASSEMBLED CAMSHAFTS, AND GRINDING-WHEEL AND REGULATING-WHEEL PAIR PROVIDED FOR THIS PURPOSE

CROSS-REFERENCE TO RELATED APPLICATIONS

This is the United States national phase of International Patent Application No. PCT/EP2014/062525, filed Jun. 16, 2014, which claims the priority benefit of German Application No. 10 2013 214 226.9, filed Jul. 19, 2013. The entire contents of each of the foregoing is hereby incorporated herein by reference.

FIELD OF THE DISCLOSURE

The invention concerns a method for centerless grinding of shaft parts, in particular tubes for assembled camshafts well as a pair of grinding wheels and regulating wheels provided for purposes of implementing the method, with the shaft parts having centering holes on one side running concentric to the axis of the workpiece.

BACKGROUND

In centerless grinding, the workpiece is usually ground between the grinding wheel and the regulating wheel while it rests on a support rail and is rotated. In doing so the regulating wheel and the grinding wheel form a gap which is closed off on the bottom by the support rail to the extent that shaft shaped workpiece is enclosed by way of linear contact with the regulating wheel, the grinding wheel and the supporting surface and its longitudinal axis is thus held in position and rotates. The goal of this configuration is that the workpiece is kept as still as possible in spite of the rotation and the out-of-roundness of the unground raw part.

The raw part that is to be ground is generally subject to a pre-machining before it is finished. The raw part has defects in shape after it is pre-machined, particularly straightness defects and/or radial defects. If a such workpiece with straightness defects is then subjected to a centerless grinding process, the workpiece is first ground at the spot where the point of highest concentric impact lies. Because of such defects in shape, the workpiece does not rest precisely upon the support rail while it is being ground. It is only after it has been fully ground that the entire length of the workpiece will essentially rest on the support rail and it can then—if at all—be ground in a defined and dimension and shape preserving manner.

A centering device, also called a center, is frequently introduced during pre-machining on each end face of the workpiece that is to be ground. This centering is to define the longitudinal axis of the finished workpiece to which the intermediate and the final machining following the pre-machining is to refer. If the workpieces with dimensional defects and defects in shape that have been produced by means of conventional centerless grinding process are then ground, these defects involving the support and/or incomplete support of the workpiece during the grinding of the latter are generally carried over to the finished part. It must however be the goal of centerless grinding that the existing centers on the workpiece are to be disposed concentrically after the grinding operation and/or only deviate from concentricity within very narrow tolerances. It is impossible to guarantee good concentricity of the centers after grinding in the case of known centerless grinding processes. This happens because of the aforesaid problems, on the one hand because of the deficient support of the work piece on the support rail and, on the other hand, because of the production inaccuracies of the workpiece when it is pre-machined.

In a process akin to centerless grinding described in DD 570, the workpiece sits on a prism-shaped groove by way of a linear contact present on each side of the supporting prism and is held in the center range by means of a pressure roller and is pressed into the prism. The known grinding method describes the grinding of two peg-shaped ends of the workpiece. The cones can only exhibit a sufficient concentricity if the workpiece has been accurately ground concentrically before, i.e. its raw contour cannot be retained. The pegs on the ends are ground by means of a grinding wheel without a thrust bearing being present on the side opposite to the grinding wheel. The concentricity accuracy required nowadays cannot be achieved by means of such a process.

DD 119 009 describes a workpiece mounting for centerless grinding of cylindrical parts, in which a grinding slot is defined in a known way by way of a grinding wheel, a regulating wheel and a support rail. A very long cylindrical rod is ground in the grinding slot by means of through feed grinding. To achieve a high concentricity and/or cylindrical shaping of the bar-like rod that is to be ground, the part applied to the support rail is clamped hydrodynamically by pockets or nozzles disposed on the support rail. The pressurization is performed in a controlled way depending on the load during the respective grinding phase. This makes it possible to minimize an out of roundness and/or radial offsets possibly deriving from the pre-machining regarding its effect on the grinding process, but this process would not achieve the desired precision in the case of straightness defects resulting from the pre-machining process.

DE 103 08 292 B4 describes a cylindrical grinding process in the production of tools made of hard metal and a cylindrical grinding machine for grinding raw cylindrical bodies in the production of tools made of hard metal. The tool is fed at the top from an endless hard metal tail stock fed through a chuck of the workpiece headstock. While this process does not involve centerless grinding, this process nevertheless also tries to achieve the highest possible straightness and the lowest possible radial offset after grinding. This is nevertheless achieved in that the a steady rest is ground after mounting and that, after successfully stabilizing the workpiece on the ground steady rest, cylindrical grinding of one of the forward moving ends of the material is performed. The process thus operates "on the moving rod".

DE 10 2010 010 758 A1 describes a method for topless cylindrical grinding of bar-shaped workpieces and a topless cylindrical grinding machine for grinding such workpieces. In this known process, several individual axially spaced regulating wheels and grinding wheels are alternatingly disposed one behind the other, i.e. stacked, namely with an axial separation such that respective grinding wheels engage in the axial space between opposite regulating wheels and/or regulating wheels in the axial space between opposite grinding wheels. Such an alternating disposition is to minimize a deflection of shaft that is to be ground. The individual grinding wheels are additionally disposed in such a way that the grinding gap becomes gradually narrower in the direction of the exit from the grinding machine. The cylindrical outer contour is thus ground by means of traverse grinding via the individual grinding wheels. The width of the regulating wheels and the grinding wheels in this known cylindrical grinding machine is clearly smaller than the length of the workpiece that is to be ground. The described alternating arrangement makes it possible to grind the entire length of the workpiece at the same time. A controlled light grinding takes place by means of a pre-centering device which is located at the entrance in the throughput direction of the workpiece that is to be ground. This known method does not describe a concentric light grinding of the end regions for purposes of centering the raw part and/or centers. Support discs are instead provided at the entrance and the exit of the device, which serve the purpose of balancing the forces due to the offset and thus non-uniformly operating grinding wheels. So that this force equalization can in fact be achieved, it is necessary, on the one hand, for the width of the regulating wheel to be greater than the width of the grinding wheel and, on the other hand, for the spindles for the regulating wheels and the grinding wheels to have sturdy dimensions and a small axial gap between the overlap regions of the regulating wheels and the grinding wheels must be realized.

The Mikrosa Company is known as manufacturers of centerless grinding wheels. It uses a method in which the workpiece is ground between so-called auxiliary centers and then, after the centers are loosened, the same workpiece is subjected to centerless finish-grinding at the same grinding station while sitting on a support rail between the grinding wheel and the regulating wheel. Both the technical formation and the alignment of the centers requires a relatively high expenditure and the entire system is difficult to control as regards precision.

GENERAL DESCRIPTION

In contrast, the object of the present invention is to provide a process for centerless grinding of shaft parts, in particular tubes for assembled camshafts, and, while keeping the geometry of the shaft parts that are to be ground in mind, a grinding wheel and supporting wheel pair by means of which defects in the profile of the raw shaft resulting from its pre-machining have a noticeably lesser effect on the precision of the finished shaft parts than that of known processes , i.e. by means of which it is possible to achieve a higher precision of the shaft part after it is finish ground.

The process of this invention is in particular intended for grinding camshaft parts so that only a minimal error in concentricity occurs and a concentricity is in fact to be attained that is not achievable by means of known centerless grinding methods.

The fundamental idea underlying the present invention is that the shaft part that is to be ground is first subjected to the centerless grinding process at its ends, without the grinding wheel and the regulating wheel first lightly grinding the undulating part at its highest radial offset. This makes it possible for the shaft part to first be attacked in the area in which centering devices are located. This allows the ground area of the shaft part to be located directly above the center, i.e. the respective centering device at the ends of the shaft part, so that it is possible to attain centrically aligned grinding of the shaft part with respect to the respective center, so that a high concentricity of the shaft part is attained at the ends of the shaft part.

In the process of this invention for centerless grinding of shaft parts, which are in particular tubes for assembled camshafts, the shaft parts to be ground, which are axially centered at their ends, are ground in a rotatingly driven fashion between a grinding wheel and a regulating wheel as is usual for centerless grinding. The grinding wheel and the regulating wheel have a width that at least corresponds to the length of the shaft part. This means that the grinding wheel and the regulating wheel have a width that is at least exactly equal to the length of the shaft part. It is however possible, even usual, for the grinding wheel in [and?] the regulating wheel to be somewhat larger than the length of the shaft part. In the usual setup for the centerless grinding of shaft parts, the grinding wheel and the regulating wheel have a radial distance to each other in the region of the ends of the shaft part, which distance is smaller than in the region between the end regions of the shaft part, i.e. in the so-called intermediate region. As viewed in the axial direction of the grinding wheel and the regulating wheel, the grinding gap required for grinding the shaft part is thus defined between the grinding wheel and the regulating wheel and is limited in the downward direction by the support rail. The distance between the grinding wheel and the regulating wheel in the radial direction is lower at the ends of the shaft part than the distance in the intermediate region between the end regions of the shaft part. It is by this means that the end regions of the shaft part are ground first. This is followed by the grinding of the intermediate region lying between the end regions, followed by the dimension and shape preserving grinding of the entire shaft part, which leads to a higher concentricity of the centering devices at the end regions than is the case with conventional centerless grinding based on the grinding performed concentrically to the centering devices at the end regions of the shaft part, even in the presence of an ever present radial offset in the case of fairly long undulating components.

The radial separation between the grinding wheel and the regulating wheel is not necessarily understood to be the smallest separation between the regulating wheel and the grinding wheel in the radial direction, but rather a separation above and below a plane comprising the longitudinal axes of both the grinding wheel and the regulating wheel wherein the undulating part is disposed and is held on the bottom by the support rail. The geometric conditions a such a centerless grinding operation are shown in FIG. 7 as a basic configuration. The position of the plane above or below is defined by whether grinding is performed above or below the middle.

In accordance with a first example embodiment, the grinding wheel and the regulating wheel are configured so that they are contoured on their sides, which correspond to the end regions of the shaft part, and have a greater diameter than in the intermediate regions between the end regions. Because of the larger diameter within the regions corresponding to the end regions of the shaft, the distance between the grinding wheel and the regulating wheel is smaller than in the intermediate region, so that the end regions are ground first during the grinding process. For that matter, the regions of the grinding wheel and the regulating wheel with a larger diameter have a diameter such that in fact the end regions of the shaft are ground first, before the grinding wheel and the regulating wheel come into contact with the shaft part in the region having the greatest radial offset. Through this setup of grinding the end ranges of the shaft part by way of regions of the grinding wheel and the regulating wheel having larger diameters, the grinding is performed concentrically to the axial centering devices of the of the shaft part and serve as it were as the basis for the sub-sequent dimension and shape preserving grinding. It is by this means that a better result of the grinding operation is achieved.

In accordance with a second example embodiment, it is however possible for the shaft part used in the centerless grinding process of this invention to have a region having a greater diameter in its end regions, preferably in the form of a collar, in which case the grinding with improved concentricity to the axial centering devices at the end regions of the shaft part is also performed first. However this is only achieved if the region having a greater diameter has a diameter such that the grinding wheel and the regulating wheel only grinds the end regions of the shaft part first without a region having the greatest radial offset having already been ground. This means that the regions of the grinding wheel and the regulating wheel corresponding to the intermediate regions of the shaft part should have diameters such that the end regions of the shaft part are ground first.

In order to improve the accuracy and/or the concentricity of the shaft part even more, a further example embodiment provides that, in the case of shaft parts having a certain greater length, the grinding wheel and the regulating wheel have a greater diameter in the intermediate regions located between the end regions of the shaft part, particularly in the middle, have a region having a greater diameter by means of which a supporting seat on the shaft part, which is also concentric to the centering devices, is also ground along with the end regions. This supporting seat is preferably ground due to the fact that the grinding wheel and the regulating wheel have a greater diameter in this region. In analogy with the grinding of the end regions of the shaft part and the correspondingly shaped profiled side regions of the grinding wheel and the regulating wheel or the greater diameter in the end regions of the shaft part, it is possible according to a further development, for the shaft part itself to preferably also have a region having a greater diameter in its intermediate region and/or end regions, which either comes into contact with the grinding wheel and the regulating wheel at the same time as the grinding of the end regions or thereafter.

It is advantageously also possible, depending on the length of the shaft parts that are to be polished, for an additional concentric supporting seat or additional supporting seats to be ground.

According to the process of this invention, in the event that supporting seats are present on the shaft part, the end regions of the shaft part are ground first the supporting seat or the supporting seats are ground thereafter and after that the shaft part along its entire length, or the end regions and the supporting seat or supporting seats are ground simultaneously.

The dimensioning of the interval, i.e. the shaping of grinding and the regulating wheel and/or the dimensions of the shaft part, either at the end regions of the shaft part or in its center region, is designed so that this interval is so small that the grinding of the end regions takes place first and the grinding in the region of the shaft part having the greatest radial offset only takes place thereafter, which is advantageously only possible a supporting seat is present in between the end regions.

In accordance with a further embodiment of the invention, the grinding wheel and the regulating wheel are profiled to a lesser extent in the intermediate range, which lies between the end regions of the shaft part that is to be ground. This slight profiling contains as many respective notches both in the grinding wheel and in the regulating wheel, as are needed in the finished shaft part for components, particularly cams. Such cam seats are not supporting seats in the sense of the present invention and only feature a small enlargement of the diameter of, e.g., approximately 0.02-0.05 mm with respect to the remaining area of the camshaft part. Such cam seats for attaching respective cams is however otherwise also ground according to the centerless grinding method of this invention so that a higher, i.e. better, concentricity is attained in comparison with known centerless grinding processes. This higher precision of the concentricity of the cam-shaft body leads to improved running and operating conditions of the finished camshaft in actual motors.

In accordance with a further aspect of the present invention, a grinding and regulating wheel pair is disclosed, which is put into a centerless grinding machine for purposes of implementing the method of this invention and which exhibits a profile such that a region having a greater diameter is present at particular opposite side regions of the grinding wheel, so that a radial separation between the grinding wheel and the regulating wheel is present there, which is smaller than in a region between these thusly profiled regions of the grinding wheel and the regulating wheel, i.e. in an intermediate region. Such a grinding wheel and regulating wheels pair makes it possible to grind a shaft part, in particular a tube for assembled camshafts, so that a ground section is first produced at the end regions of the shaft part, which section is formed concentrically to the axial centering devices, before the intermediate region of the shaft part lying in between the end regions can be ground in a dimension and shape preserving manner. Such a grinding wheel and regulating wheel pair of this invention thus achieves a greater concentricity of the finish-ground shaft part.

BRIEF DESCRIPTION OF THE DRAWINGS

Additional advantages and special details of concrete embodiments of the process of this invention and/or of the grinding and regulating wheel pair of this invention will now be described by means of the following drawings. The drawings show.

DETAILED DESCRIPTION OF THE DRAWINGS

Figure 5:
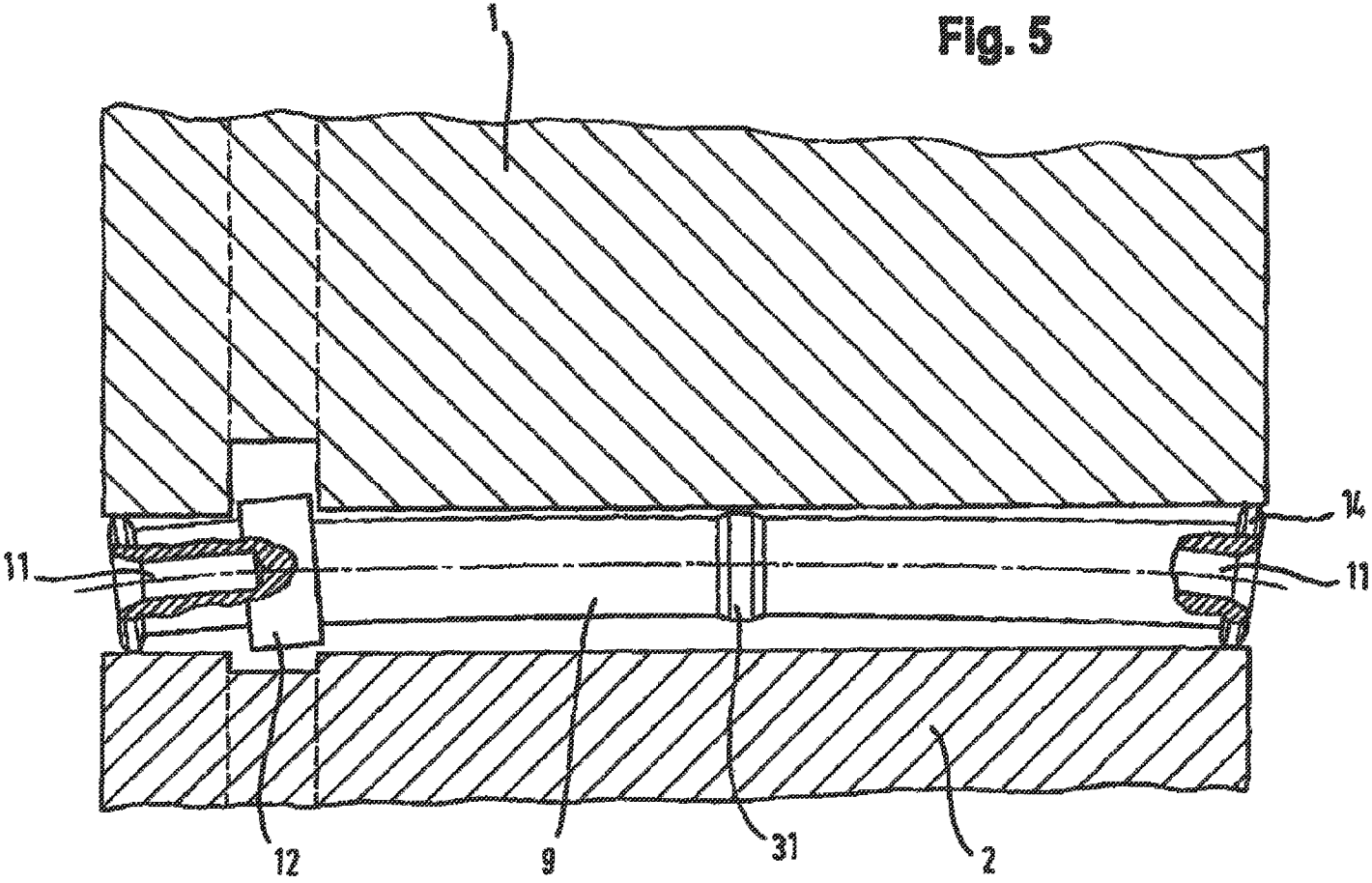
FIG. 5 an example embodiment in accordance with FIG. 4, in which the grinding operation by means of a grinding wheel and a regulating wheel is performed at the respective end region of the shaft part in the presence of the greater diameter of the shaft part existing there, with a region having a larger diameter additionally being present on the work piece in the region of the maximum radial offset, which is provided for purposes of producing a ground region for a supporting seat.
Figure 6:
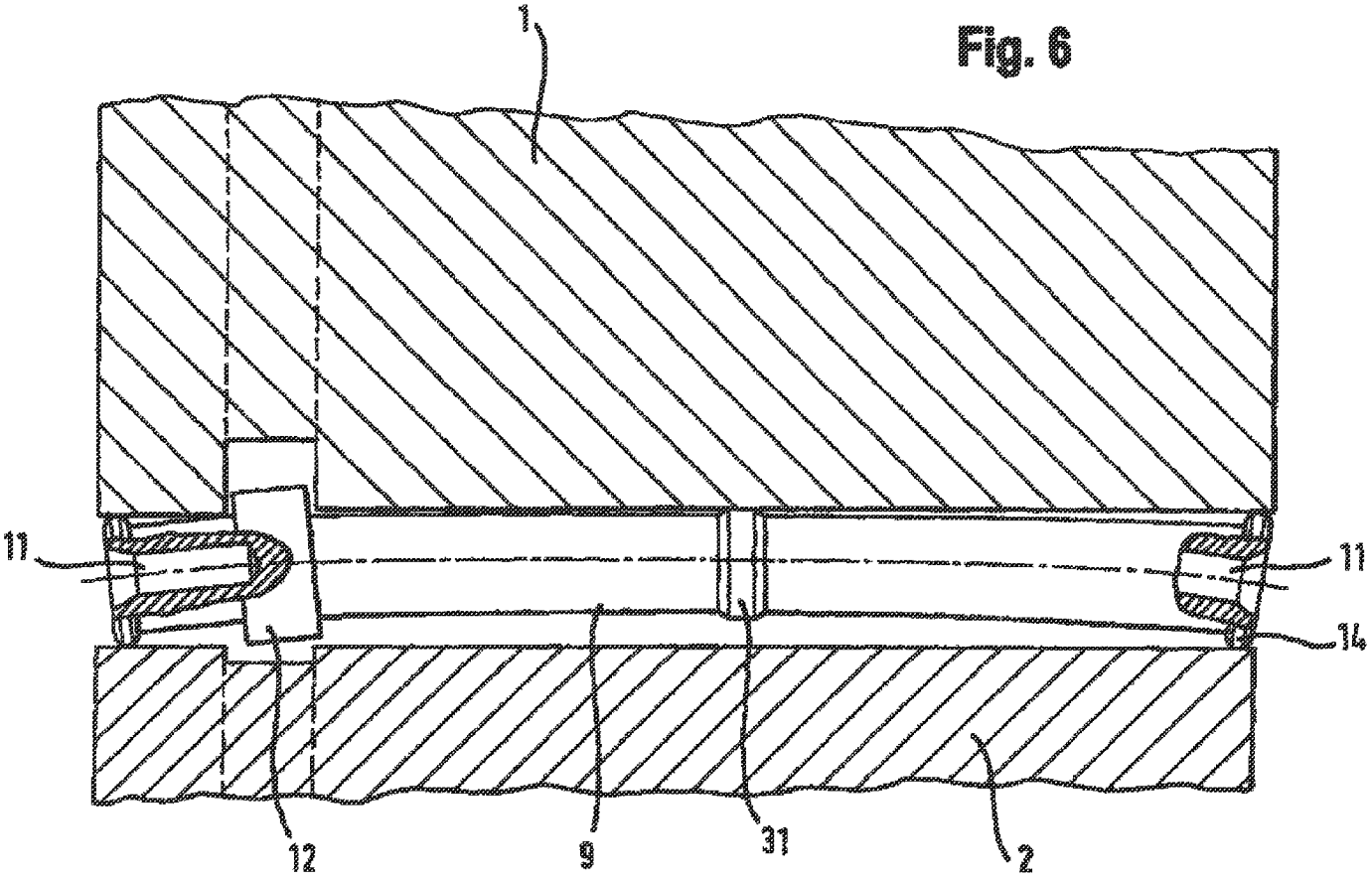
FIG. 6 the configuration in accordance with FIG. 5, wherein however the region of the work piece having a greater diameter provided for the supporting seat is just being ground as well.
Figure 7:
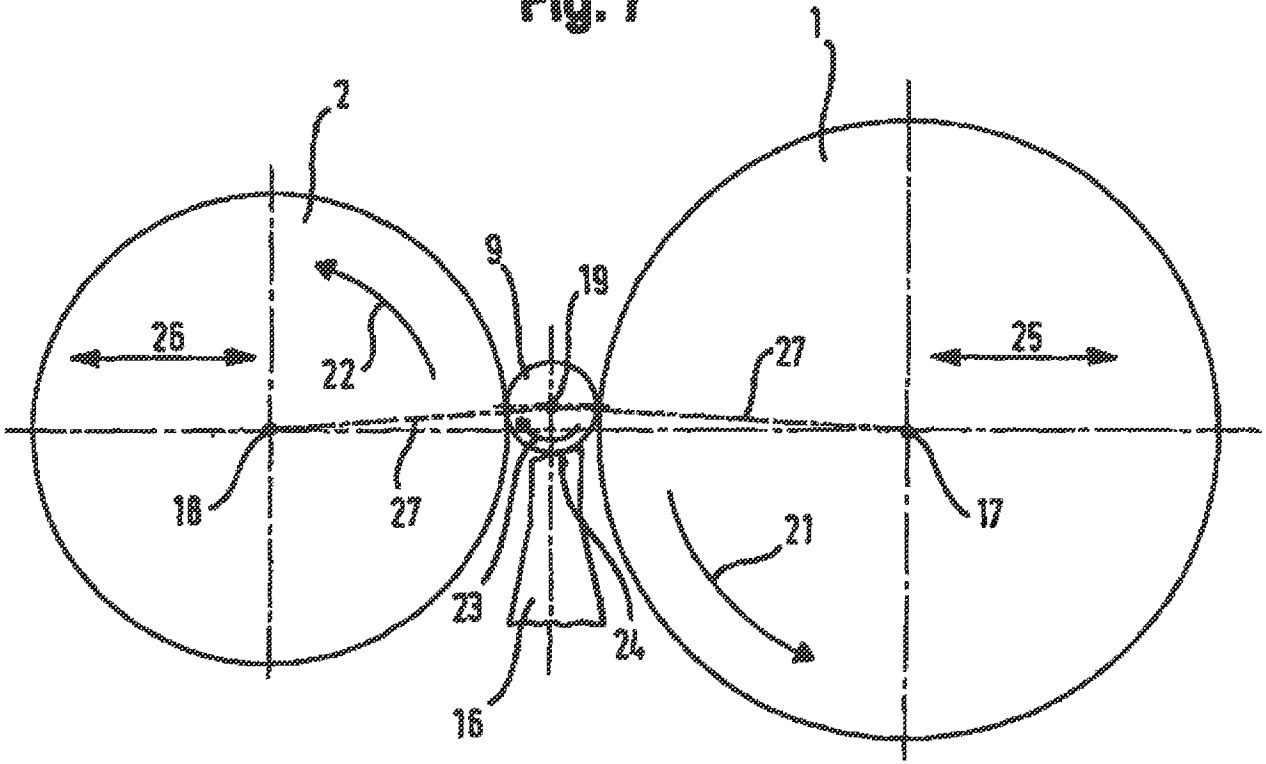
FIG. 7 the general configuration of the grinding gap in the axial direction of the grinding wheel and the regulating wheel with a representation of the separation between the grinding wheel and the regulating wheel in the grinding gap in the case of centered grinding and support by a support rail.

FIGS. 1 to 6 show a to view of a basic configuration with the positioning of the work piece between the grinding wheel 1 and the regulating wheel 2 a cross-sectional view thorough the sectional plane 27 according to FIG. 7.

Figure 1:
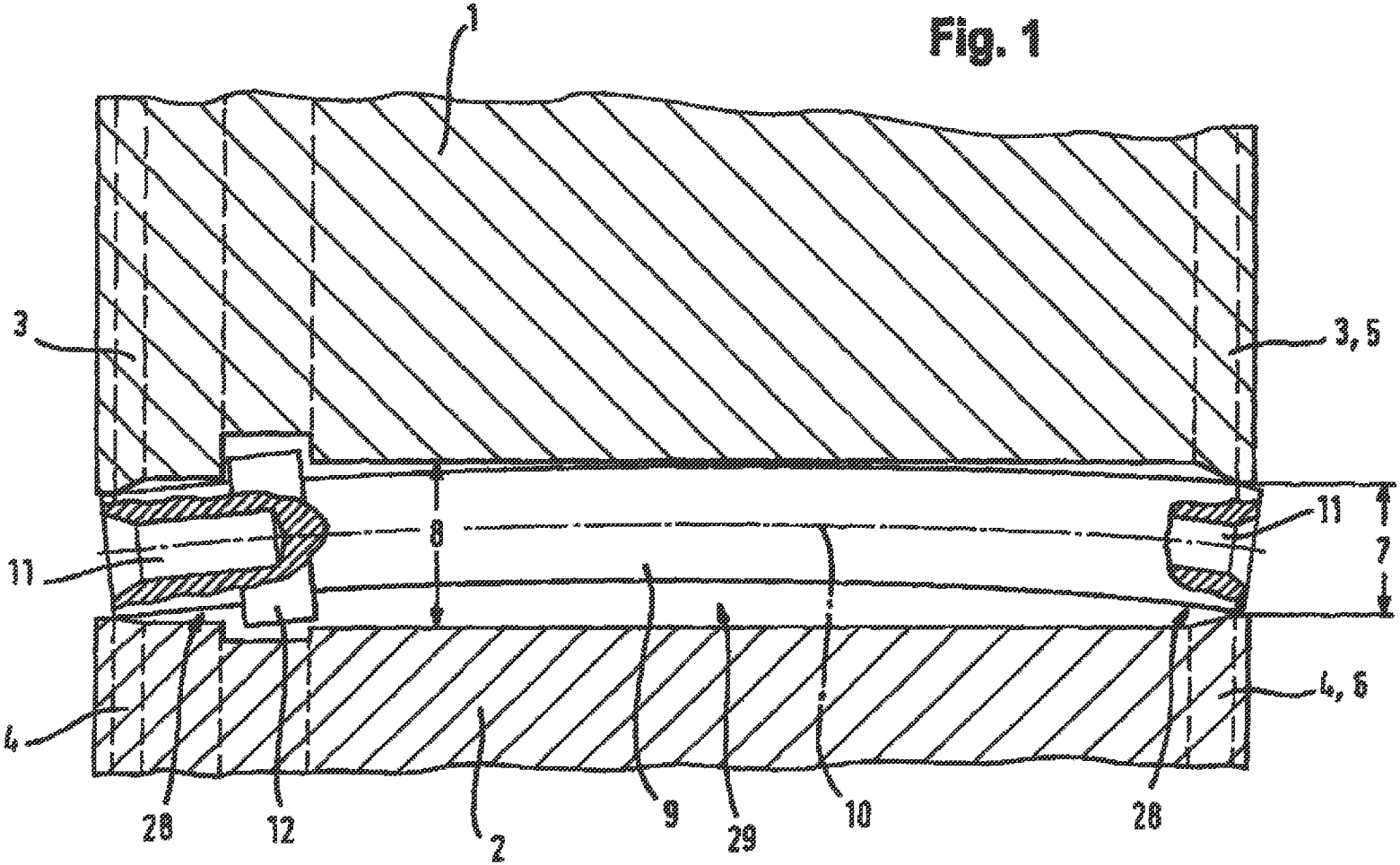
FIG. 1 a basic configuration of a grinding wheel and a regulating wheel with a shaft part having a radial offset, whose end regions are ground first by means of grinding wheels and regulating wheels that are shaped accordingly on the sides.

In FIG. 1 a shaft part 9 is placed between the grinding wheel 1 and the regulating wheel 2, which has a curvature shown in an overstated way, so that a maximum radial offset is present in this intermediate region. Both the grinding wheel 1 and the regulating wheel 2 have profiled shapes 3 and 4 in their lateral end regions, which comprise regions of the grinding wheel 1 having a greater diameter 5 and regions of the regulating wheel 2 having a greater diameter 6. In doing so, the diameters of the regions having greater diameters 5, 6 are dimensioned so that a grinding operation is performed by means of them at the end regions of the shaft part 9 at which centering devices 11 are introduced into the respective end faces before the grinding wheel 1 and the regulating wheel 2 comes into contact with the shaft part 9 in the region where the latter exhibits the greatest radial offset. By means of the profiling 3, 4 of the grinding wheel 1 and the regulating wheel 2, the separation between the grinding wheel 1 and the regulating wheel 2 in the region in which the respective end regions of the shaft part 9 are to be ground is smaller than the separation 8 of the intermediate region 29 in between the end regions 28. In the case of the profiling 3, 4 of the grinding wheel 1 and the regulating wheel 2 in the end region 28 of the shaft part 9 an defined initial grinding operation—with respect to the progress of the entire grinding operation—is performed on both end regions 28 of the of the shaft part, whereby a high level of concentricity of the end regions 28 of the shaft part 9 and/or of the centering devices 11 introduced into the end regions 28 is achieved.

Both FIG. 1 and FIGS. 2 to 6 show a shaft part 9, which has a collar which is ground by means of the centerless grinding operation along with the outer diameter. A suitable notch is provided for this purpose in the grinding wheel 1 as well as in the regulating wheel 2. The profiled parts 3, 4 of the grinding wheel and the regulating wheel 2 according to FIGS. 2 to 6 have dimensions identical to those in the configuration according to FIG. 1. In addition to the example embodiment in accordance with FIG. 1, the grinding wheel 1 and the regulating wheel 2 according to FIG. 2 has an additional profiling 30 approximately in the region of the maximum radial offset of the shaft part that is to be ground, which profiling produces a separation 13 for ground supporting seat 15 (see FIG. 3). In the representation in accordance with FIG. 2, the separation 13 for the supporting seat is dimensioned so that the end regions 28 of the shaft part of 9 are nevertheless ground first by means of the profiled parts 3, 4 of the grinding wheel 1 and the regulating wheel 2 before the supporting seat 15 is ground by the profiled parts in the region of the greatest radial offset.

Figure 2:
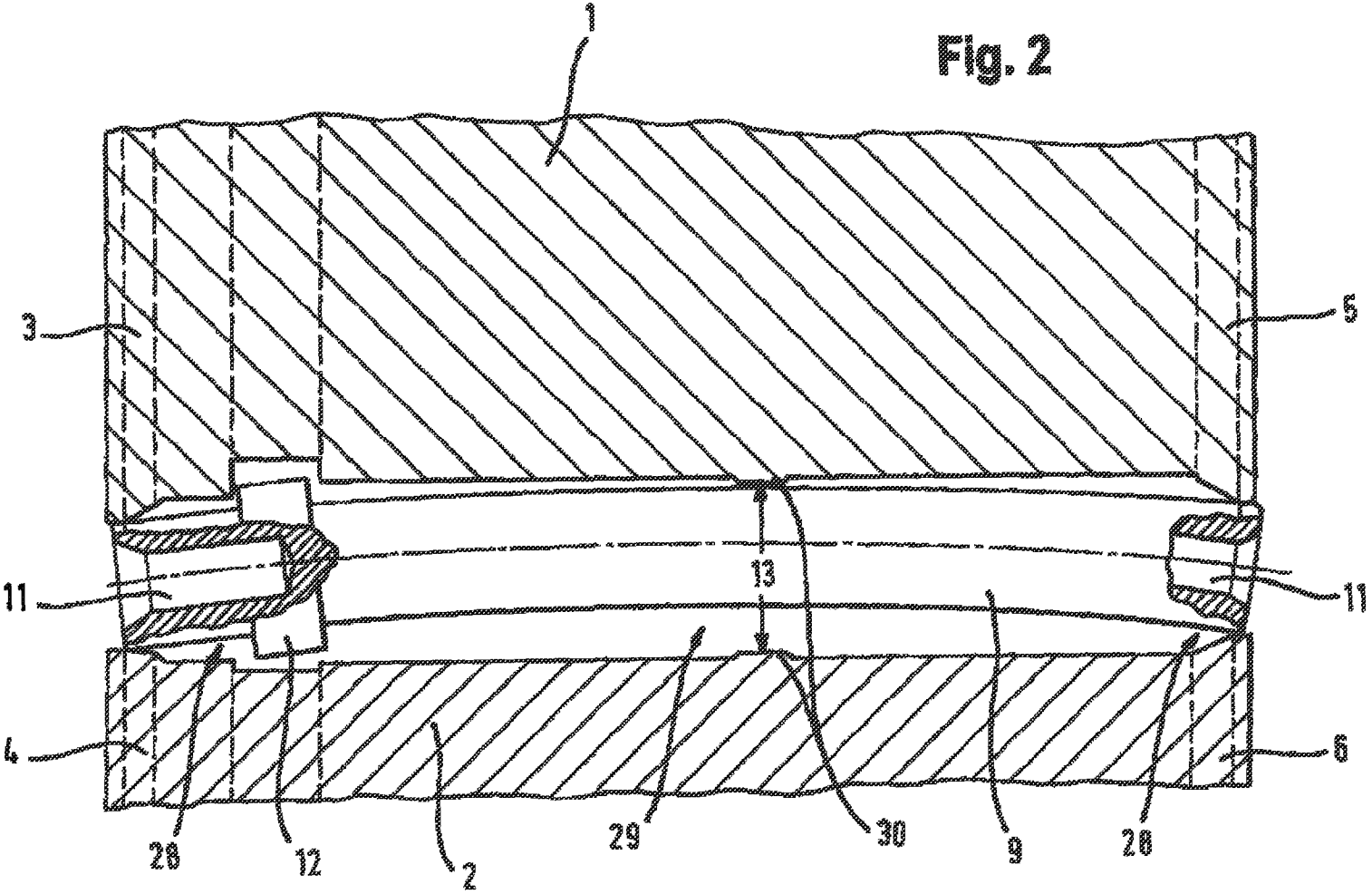
FIG. 2 a configuration as in FIG. 1, but with additional profiling in the intermediate region between the end regions for purposes of producing an additional ground section for a supporting seat, which has not yet come into contact with the shaft part in the region having the greatest radial offset.
Figure 3:
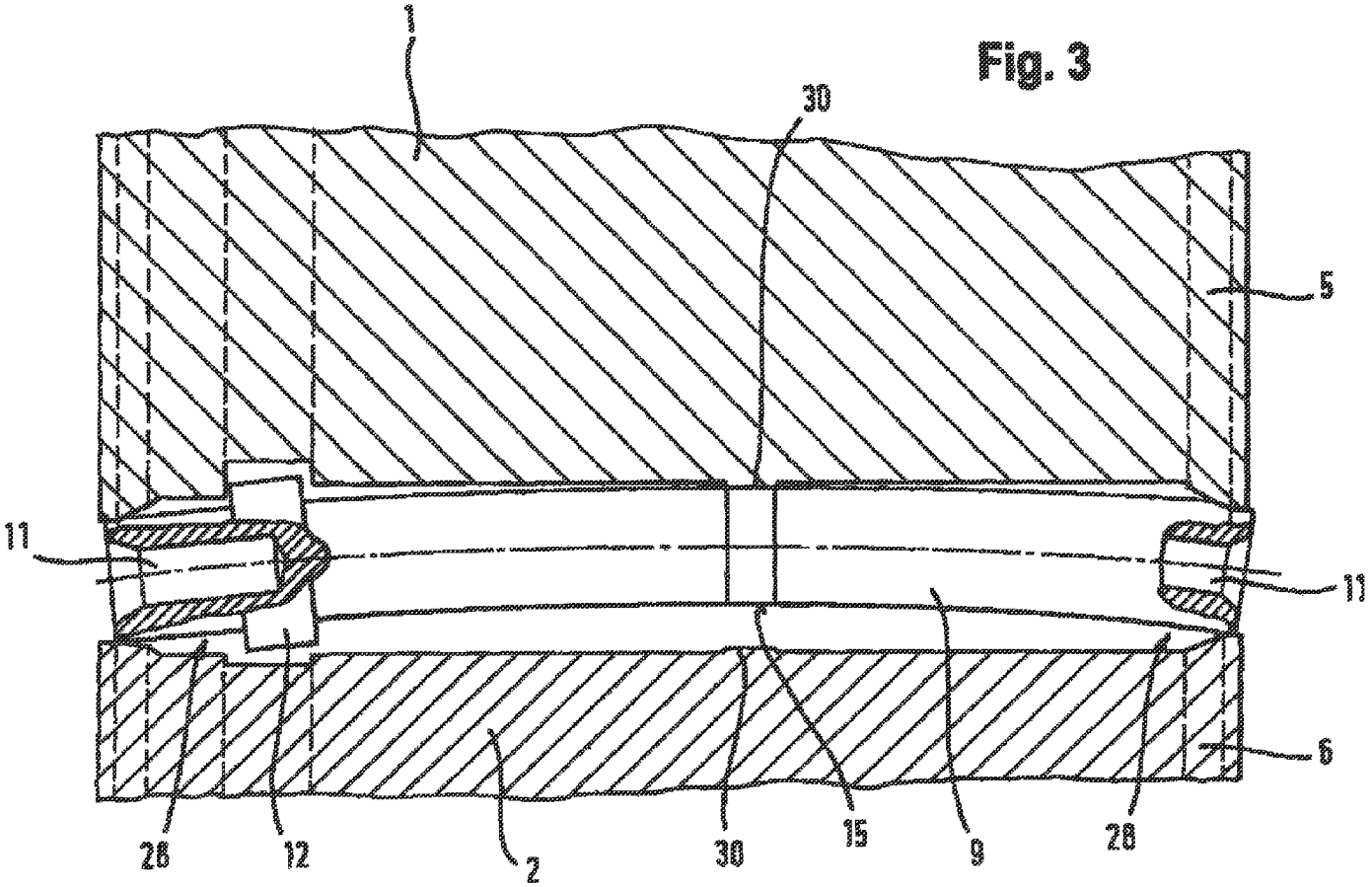
FIG. 3 a configuration in accordance with FIG. 2, in which contact with the grinding in the region of the greatest radial offset has just occurred.

In FIG. 3 shows an example embodiment in accordance with FIG. 2, wherein the profiling 30 in the region of the greatest radial offset of the shaft part by the grinding wheel 1 and the regulating wheel 2 has just been started and the end regions 28 of the shaft part 9 have been at least partly ground.

Figure 4:
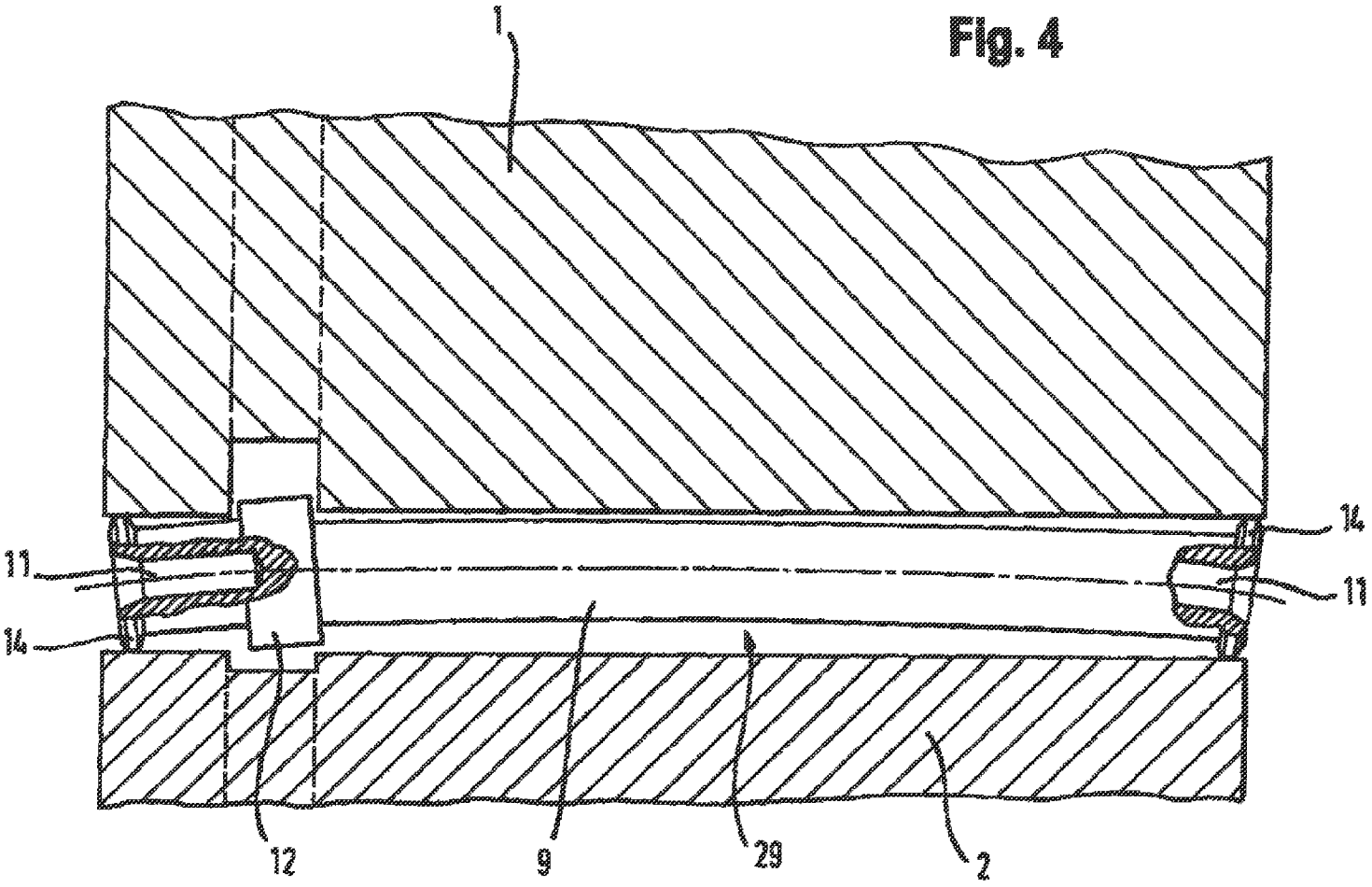
FIG. 4 an example embodiment in which grinding wheel and regulating wheel essentially have a constant diameter, but the shaft part has a region having a greater diameter at each of its end regions, which region is provided for a grinding process according to this invention.

FIG. 4 shows another example embodiment of this invention, in which the grinding wheel 1 and the regulating wheel 2 relating to the dimensional and form stability of the shaft part 9 have substantial regions having a constant diameter. Both the grinding wheel 1 and the regulating wheel 2 thus show profiled areas in their end zones, except for the flange 12 on the shaft part 9. The shaft part of 9 is instead configured in so that it has collars, i.e. regions having a greater diameter, at of which has a maximum radial offset at about the middle thereof. In the situation shown in FIG. 4, the grinding wheel 1 and the regulating wheel 2 have not yet engaged the shaft part 9. It is however evident the engagement will occur shortly. According to the invention, the engagement occurs first in the region of the collar, i.e. at the end regions of the shaft part 9, because the separation between the grinding wheel 1 and the regulating wheel 2 is smaller there than in the intermediate region, even in the region of the greatest radial offset of the shaft part 9.

In FIG. 5 shows another example embodiment in which an engagement occurs by way of the region having a greater diameter, i.e. the collar 14 in the end region of the work piece 9, with the situation at just the time when the grinding wheel 1 and the regulating wheel 2 engage being shown. a region having an enlarge diameter 31 on the shaft part, i.e. an additional collar, is provided in the region of the enlarged radial offset error of the shaft part 9, which collar is provided for purposes of grinding an additional supporting seat. Such an additional supporting seat is first of all expedient if certain greater lengths of the work piece, i.e. of the shaft part, are present. However in the situation in accordance with FIG. 5, the region where the supporting seat is to be located has not yet been ground. It is only when the end regions of the shaft part 9 have been sufficiently ground that the grinding wheel 1 and the regulating wheel 2 come into contact with the center collar of the work piece in order to grind a supporting seat.

This situation is shown in FIG. 6, whose details however otherwise correspond entirely to the representation in FIG. 5.

FIG. 7 shows a simplified representation of a side view, i.e. a view in the direction of the longitudinal axes of the grinding wheel 1 and the regulating wheel 2, of the configuration of the separation between the grinding wheel and the regulating wheel as well as the disposition of the shaft part 9 at this distance, i.e. in the grinding gap, in conjunction with the support rail. The undulating part and/or the shaft part 9 is put into motion about the longitudinal axis 19 upon contacting the contact surface 24 of the supporting rail by engaging the grinding wheel 1, which is driven in the rotational direction 21. The regulating wheel 2 also engages the shaft part 9 on the opposite side in the rotational direction 22 and, along with the contact surface 24 of the support rail for applying the grinding forces by way of the grinding wheel 1. The grinding wheel 1 rotates about its rotational axis 17 and the regulating wheel 2 about its rotational axis 18. Depending on current diameter of the work piece, the grinding wheel 1 is advanced in the advance direction 25, with the direction of advance 25 being represented by a double arrow 26. In this case, the direction of advance signifies a negative or a positive direction of advance, which is respectively shown by the double arrows 25 and/or 26. The section plane through the grinding wheel 1 and the regulating wheel 2 is represented by the reference number 27, so that the separation shown in FIGS. 1 to 6 refers to the separation with respect to the section plane 27.

The method of this invention and the grinding wheel and regulating wheels pair used for the implementation of this invention make it possible to produce a higher concentricity of an undulating part with respect to the centering devices located in the end regions. According to this invention, both the method and the grinding and regulating wheel pair prevent radical offset errors that are always present on shaft parts from having a negative effect on the rotational accuracy and/or concentricity of the finished component.

The invention claimed is:

1. Process for centerless grinding of shaft parts, wherein the shaft part (9) that is to be ground, having axial centering devices (11) on its front faces is ground in a rotatingly driven fashion in a space between a grinding wheel (1) and a regulating wheel (2), wherein the grinding wheel (1) and the regulating wheel each have a width that at least corresponds to the length of the shaft part (9) and wherein end regions (28) of the shaft part (9) are first ground at regions formed concentrically to centering devices, which is followed by the grinding of an intermediate region (29) lying between the end regions (28), then followed by a dimension and shape preserving grinding of the entire shaft part (9) to the finished size on the basis of grinding at the end regions (28) of the shaft part (9) lying on a support rail performed concentrically with the centering devices (11).

2. Process according to claim 1 wherein the end regions (28) of the shaft part (9) are ground between the grinding wheel and the regulating wheel by means of the grinding wheel (1) and the regulating wheel (2) having a larger diameter at each of the end regions (28) with a smaller gap (7) between the grinding wheel and the regulating wheel formed thereby in the end regions of the shaft part.

3. Process according to claim 2 wherein each end region (28) of the shaft part (9) has a region designed in the form of a collar (14) having an enlarged diameter and wherein the grinding wheel (1) and the regulating wheel (2) have diameters in the regions corresponding to the intermediate regions (29) of the shaft part (9) such that the collars (14) of the shaft part are ground first.

4. Process according to claim 1 wherein both the grinding wheel (1) and the regulating wheel (2) have a region that has a larger diameter in the intermediate region (29) lying in between the end regions (28) by means of which at least one support rail that is concentric to the centering devices (11) is ground on the shaft part (9).

5. Process according to claim 1 wherein at least one support rail (15) that is concentric to the centering devices (11) is ground by means of an intermediate region (29) having an enlarged diameter lying in between the end regions (28) of the shaft part (9) so as to decrease the gap (8) between the grinding wheel (1) and the regulating wheel (2) in this intermediate region (29).

6. Process according to claim 4 wherein the end regions (28) of the shaft part (9) are ground first, followed by grinding the at least one support rail (15) and then by grinding the shaft part (9) along its entire length.

7. Process according to claim 4 wherein the end regions (28) and the at least one support rail (15) are ground simultaneously.

8. Process according to claim 2 wherein the smaller gap (7) provided in the end regions (28) of the shaft part (9) has a magnitude such that grinding at the biggest radial offset existing in the region between the end regions (28) is, at the earliest, initiated after the grinding of the end regions (28) has been completed.

9. Process according to claim 3, wherein the collar (14) provided at the end regions (28) of the shaft part (9) has a diameter such that grinding at the biggest radial offset existing in the intermediate region (29) between the end regions (28) begins at the earliest after the grinding of the end regions (28) of the shaft part (9) has been completed.

10. Process according to claim 1, wherein the shaft parts are tubes for assembled camshafts.

* * * * *